US006312570B1

(12) United States Patent
Mroz, Jr.

(10) Patent No.: US 6,312,570 B1
(45) Date of Patent: Nov. 6, 2001

(54) MATERIALS FOR USE IN ELECTROCHEMICAL SMELTING OF METALS FROM ORE

(75) Inventor: Thomas J. Mroz, Jr., Kenmore, NY (US)

(73) Assignee: Advanced Refractory Technologies, Inc., Buffalo, NY (US)

( * ) Notice: Subject to any disclaimer, the term of this patent is extended or adjusted under 35 U.S.C. 154(b) by 0 days.

(21) Appl. No.: 09/500,251

(22) Filed: Feb. 8, 2000

Related U.S. Application Data

(63) Continuation of application No. PCT/US99/02937, filed on Feb. 8, 1999.

(60) Provisional application No. 60/074,114, filed on Feb. 9, 1998.

(51) Int. Cl.[7] ..... B01D 59/50

(52) U.S. Cl. ..... 204/247.3; 204/243.1; 204/291; 205/380; 205/385; 205/387

(58) Field of Search ..... 204/243.1, 247.3, 204/291; 205/354, 364, 367, 372, 380, 385, 387

(56) References Cited

U.S. PATENT DOCUMENTS

| | | | | |
|---|---|---|---|---|
| 4,511,449 | * | 4/1985 | Molnar | 204/247.3 |
| 4,514,268 | * | 4/1985 | De Angelis | 204/247.3 |
| 4,529,494 | * | 7/1985 | Joo et al. | 204/243.1 |
| 5,286,359 | * | 2/1994 | Richards et al. | 204/243.1 |
| 5,527,442 | * | 6/1996 | Sekhar et al. | 204/247.3 |
| 5,651,874 | | 7/1997 | de Nora et al. | 205/372 |

FOREIGN PATENT DOCUMENTS

| | | |
|---|---|---|
| 2675141 | 10/1992 | (FR) . |
| WO 97/18162 | 5/1997 | (US) . |

OTHER PUBLICATIONS

Mroz, Chemical Abstracts 127:240193 (Oct. 1997) Mroz, JOM 49(8):24–25 & 71(Aug. 1997).

Barsoum et al., J. Am. Ceram. Soc. 79(7):1953–1956(1996). No Month Available.

* cited by examiner

*Primary Examiner*—Bruce F. Bell
(74) *Attorney, Agent, or Firm*—Braman & Rogalskyj, LLP

(57) ABSTRACT

This invention relates to a new family of materials that exhibits improved stability to the chemical environment used in metal ore reduction, and thus provides an opportunity for improving the energy use and efficiency of such processes by their use. More specifically, the inventions relates to an electrode, used in the construction and/or operation of a reduction cell use to produce metal from ore, which is comprised of a compound or compounds described by the chemical formulas $M_3NX_2$ or $M_2NX$, where M is a transition metal, N is a group 3a, 4a or 5a element, and X is carbon or nitrogen; or a composite containing in part, at least one of such compounds.

31 Claims, No Drawings

MATERIALS FOR USE IN ELECTROCHEMICAL SMELTING OF METALS FROM ORE

The application is entitled to priority benefit of U.S. Provisional Patent Application Ser. No. 60/074,114, filed Feb. 9, 1998, which is hereby incorporated by reference. This application is a continuation of PCT application PCT/US99/02937, filed Feb. 8, 1999, which is hereby incorporated by reference.

FIELD OF THE INVENTION

This invention relates to a new family of materials that exhibits improved stability to the chemical environment used in metal ore reduction, and thus provides an opportunity for improving the energy use and efficiency of such process by their use.

BACKGROUND OF THE INVENTION

An estimated 20 million tons of aluminum is produced each year by electrochemical smelting of aluminum oxide. The smelting operation is typically carried out in reduction cells, using a semi-continuous process. Aluminum oxide is dissolved in a molten cryolite salt bath, where it is reduced to aluminum metal and oxygen by electrolysis. The molten metal sinks to the bottom of the cell, and is periodically removed by siphon.

Electrical power is supplied to the cell by anodes, which are connected above the cell to a buss bar. The anodes are inserted into the molten bath of cryolite and aluminum oxide, and the provision of current from their surface results in the electrolysis reaction on their surface. Current collection typically occurs along the bottom surface of the cell, through conductive floor materials. Imbedded deep within these materials are iron collector bars, which extend through the outer shell of the vessel and complete the electrical circuit. The molten aluminum metal pool on top of the current collector provides the cathodic surface, and thus is an integral part of the electrical circuit. Maintenance of a continuous molten aluminum surface is therefore important to the efficient operation of the cell. It should be noted that other metals can be produced in this manner, including, in particular, magnesium.

Reduction cells are constructed primarily out of carbon-based refractory materials and are designed to last for 5–7 years. Historically, carbon is also used for both the anode and current collector materials. Pressed and fired carbon blocks are used for the anodes, as they provide suitable electrical conductivity and chemical stability against the molten reactants. However, oxygen driven off of in the electrolysis reaction reacts with the carbon anode to form $CO_2$ gas, which must be removed safely from the system. Over ⅔ lb. of carbon are consumed for each pound of aluminum formed, resulting in more than 1.5 lbs of $CO_2$ evolution into the environment. The total, worldwide production and subsequent release of $CO_2$ into the environment due to this process is in the billions of tons annually. Additionally, the consumption of the anode by oxygen results in the requirement for frequent, periodic replacement of the anodes. Most aluminum smelting plants require an on-site plant dedicated to the continuous production of carbon anodes to satisfy the continual need for these components. The anode production method also contributes to release of pollutants, including $CO_2$ as well as various toxic organic and metallic materials.

Carbon current collector material is produced by extrusion and firing. The "cathode" block carbon is mated to the iron buss bars, then inserted into the base of the reaction cell. Because of their location, these carbon materials are not generally consumed during cell use and do not need in-service replacement. However, over time, various factors resulting from the operation of the cell may cause loss of this material by erosion or corrosion. Eventually, regions on this cathodic surface erode to the iron buss bars, which are quickly consumed by aluminum metal. The result is loss of molten metal and cryolite through the floor of the cell through the consumed buss bar. This "tap out" of the cell is one of two most predominant reasons for cell shut down and replacement. While "tap out" of a cell may not occur until the cell has operated about 5 years, the vast number of cells in an operating smelter requires replacement and installation of new cells on a continuous basis.

Hall-Heroult materials are typically carbon based and are specifically chosen for where they will operate in the cell. Carbon generally meets most of the requirements, but specific types of carbon are chosen based on density, conductivity and purity. The materials used in the structural components of Hall-Heroult cells have not changed much since their initial invention. The existing materials limit the useful life, and performance of the cells and therefore the impact the final economics. Huge potential improvements exist in terms of energy consumption, process optimization and pollution control, which are limited by the available choice of materials.

The general requirements for improved materials for the electrodes in Hall cell application include:

| Anode Material | Cathode Material |
|---|---|
| Electrical conductivity (critical) | Electrical conductivity (critical) |
| Inertness to aluminum and cryolite | Inertness to A1 and cryolite |
| Oxidation resistance (critical) | Oxidation resistance |
| Thermal shock resistance | Erosion resistance |
| Mechanical strength | Wetted by Al metal (critical) |

Due to their application, it is clear that both the anode and cathode materials need to be electrically conductive, as well as inert or resistant to the chemistry of the reactant system. Many of the other required properties are the same for both applications, but their priority is somewhat different. In the case of the anode, where oxygen is being produced at temperatures of nearly 1000° C., the oxidation resistance of the material is of greatest significance. For the cathode, complete coverage by the molten Al metal (also referred to as "pad") is critical to provide the best electrical efficiency. Thus, Al wettability of the surface is of highest priority.

Interestingly, carbon is used for both applications, however it does not meet the requirements of the most critical parameters for either. In both cases, allowances are made to force carbon to work, as carbon has historically been the best and lowest cost material to cover the greatest portion of the requirements. In the case of anodes, oxidation of the carbon to $CO_2$ is allowed and compensated for by continuous replacement of the anodes. For cathodes, poor wettability by aluminum is compensated for by use of a thick metal pad of several inches. These compromises have served the industry well throughout its early and middle years. However, new constraints are forcing a reevaluation of these allowances.

In the case of the carbon anode, issues with pollution are most critical. The continuous production of huge numbers of anodes contributes to release of hydrocarbons, pitches and tars, and metallic species into the environment. Later, during operation, the consumption of the anode releases massive amounts of $CO_2$ into the air. Production of $CO_2$ is estimated at more than 200,000 tons per year per smelter. While oxidation of the anode to $CO_2$ occurs during the reduction process and provides heat energy to the system, it is not a required reaction in the metal reduction process. Use of a carbon-free material in this application would virtually eliminate production of $CO_2$, resulting instead in production of oxygen. Thus, a significant pollution source would be eliminated. Furthermore, use of the significant petroleum and power resources required to make carbon anodes would be greatly diminished, which would have secondary impact on production costs as well as vital resource consumption.

For carbon cathodes, the issue of wettability requires a compromise in metal pad thickness. In order to force cathode coverage, metal pads of several inches thickness or more are used. The anodes are placed in proximity to the top of the metal pad, and adjusted to maintain a certain distance (referred to as the anode-cathode distance, or "ACD"). The thicker the ACD, the less electrically efficient the cell, so maintaining the ACD at minimum level is economically important. Unfortunately, the thick metal pad forces the ACD to be greater than desired. When sufficient metal accumulates, magnetic forces in the cell (caused by the significant current flow) create currents and waves in the metal pad. Should the unstable pad surface come in contact with the anode, the cell will short and become difficult to maintain in steady state. Therefore, typical cell operations require ACD sufficiently large enough to compensate for these conditions. A cathode exhibiting aluminum wettability would not require the thick metal pad, and thus magnetic irregularities would be greatly diminished. Electrode ACD could then be significantly reduced without concern of shorting, and consequently, significant energy savings (on the order of 20%+) could be realized. The monetary value of this energy savings is in excess of hundreds of millions of dollars annually, and also has obvious impact on the requirement for valuable energy providing resources. Cell designs that incorporate wettable cathodes typically use sumps to control the metal pad to minimal levels, and thus are termed "drained" cells.

The investigation into improved materials for non-carbon anodes and cathodes is as old as the technology itself. Obtaining materials with suitable electrical and chemical resistance properties to operate successfully for extended periods in the cell environment has proven a formidable task. To date, while a few materials have shown some promise, the overall performance and value/cost ratio of these technologies has limited their widespread introduction into the market.

For example, TiB2 has been examined for the Hall cell cathode application. While it generally provides the technical requirements for improved cathodes, the material exhibits a degree of solubility in cryolite salt over long periods of exposure that put into question the long term viability of the material. Despite many years of study, and even development of supportive cell operation procedures, the viability of this material for cathode applications has not been definitively established.

SUMMARY OF THE INVENTION

Disclosed herein is a new family of materials that provides improved electrical conductivity and chemical corrosion stability against molten metals and salts compared to materials previously described and commercially available. Additionally, these materials exhibit excellent thermal shock resistance, high temperature oxidation resistance, and machinability; all of which are desirable traits for high temperature materials-containment applications in general. Specific compounds within this family of materials can be used singly, in combination, or in composite mixtures with other-materials including transition metal non-oxide ceramics and carbon compounds.

Because of these characteristics, compositions within this family of materials are suitable for use as electrodes in metal reduction cells, such as the Hall-Heroult cell used in the smelting of aluminum metal. Aluminum wettability and chemical corrosion stability support use of these materials in the cathode application. Corrosion stability, oxidation resistance and thermal shock resistance support use in the anode application. The opportunity for improvements in pollution control and energy efficiency in metal smelting by using these materials is extremely significant, and could have a large impact on the extent to which this industry impacts world resources.

DETAILED DESCRIPTION OF THE INVENTION

A new family of non-oxide materials has recently been discovered. This family of materials is characterized by compounds that comprise transition metals, group 3a–5a materials, and carbon or nitrogen to form complex compositions. The basic formulas included within this family are $M_3NX_2$ and $M_2NX$, where M is a transition metal, N is a group 3a, 4a or 5a element, and X is carbon or nitrogen. The crystal structures of materials within this family generally appear to be transition metal non-oxide compounds with planer disruptions to allow for incorporation of the 3a, 4a or 5a elements. This stackwise disruption of the crystal structure leads to intragranular slip planes which, in turn, support unusual physical properties. The mixture of bonding types also contributes to these unusual properties These materials exhibit a number of ceramic-like properties, including high strength and refractoriness and good corrosion resistance. Conversely, they also provide a number of properties that are unusual for ceramics, including very high thermal shock resistance, high toughness, high electrical and thermal conductivity, and machinability. It is the particular crystal structure and mixture of bonding types that results in this unprecedented combination of properties.

While some comparative work has been done between various compositions within this family of materials, the most significant evaluation has been performed on the compound $Ti_3SiC_2$. Early evaluation of this material has shown it to have electrical conductivity 2 orders of magnitude better than graphite, while retaining the machinability and thermal shock resistance noted for graphite. Oxidation resistance exceeds 1100° C., and corrosion resistance against molten salts, acids, and corrosive gasses has been found to be excellent, in general. Wettability of the material with molten salts and metals has generally been established as well. Many of these properties have been initially confirmed in compounds with the form of $M_2NX$ as well, including $Ti_2AlC$, and $Ti_2AlN$.

This combination of properties generally meets all of the criteria required of improved electrodes for metal reduction applications, particularly in cases of the production of aluminum as well as magnesium and other metals. The electrical performance will result in less resistive loss than for traditional carbon and graphite materials. The corrosion and oxidation resistance show promise for stability in the chemical environment of the reduction cell. The damage tolerance of the material provides significant improvement over traditional carbon materials, as well as experimental $TiB_2$ compounds. Metal wettability provides additional opportunity in allowing for drained cell configurations, which ultimately supports significant improvement in electrical efficiency.

Evaluation of composites based on these materials has also been performed. In general, these materials are stable in contact with carbon, and various non-oxide transition metal and 3a/4a compounds such as AlN, SiC, etc. Thus, a variety of composite can be produced to further modify the properties of the material. For instance, composites of $Ti_3SiC_2$ and TiC have been prepared at TiC concentrations of 2% to over 70% by volume, without observing deleterious effects on the $Ti_3SiC_2$ matrix. Similarly, composites with carbon additions can be formed without affecting the $Ti_3SiC_2$ matrix. Additions of TiC or carbon may provide cost advantages in the production of this material without degrading the overall performance of the material. As long as the $M_3NX_2$ or $M_2NX$ phase remains continuous (generally expected to occur down to the percolation limit of about 30 volume percent), much of the physical, chemical and electrical performance will be retained. A preferred composition may contain 50 percent or more of the $M_3NX_2$ or $M_2NX$ phase by volume. Most preferred compositions would contain 75 percent of more of the the $M_3NX_2$ or $M_2NX$ phase by volume. Composites may include more than one of the $M_3NX_2$ or $M_2NX$ phases and retain value to the application.

Metal reduction cells generally incorporate the anode(s) and cathode(s) into the cell at relatively close proximity, with an electrolytic material surrounding and separating the alternate electrodes. In the case of Hall-Heroult cells, the most typical configuration incorporates the insertion of multiple anodes inserted into the electrolyte (cryolite) bath from the top of the cell. The bottom floor of the cell is constructed from carbon materials, which provides the electrical conduction to the return circuit through buried iron buss bars. In operation, the product aluminum provides the actual cathodic surface, and the carbon cell floor (positioned directly below and in contact with the aluminum pool) represents the cathodic current collector. It should be understood that in the literature, and in the common parlance of the application, that carbon cell floor is referred to interchangeably as the cathode or current collector. The semantics and actual use of the materials in this cell are well understood by those skilled in the technology, and interchange of these terms does not limit their application. For all further discussions in this disclosure, the term "cathode" will be used to describe the material or materials that provides all of the structural and electrical properties required to operate the cell, configured between the metal cathodic pad and the iron buss bars. In traditional Hall-Heroult cells, this material is typically comprised of carbon.

In Hall-Heroult cell operation, the cryolite or similar electrolyte provides the electrolytic medium for current conduction between the anode and cathode. It also dissolves the ore, allowing it to be electrochemically separated into the constitutive metal product, and oxidative by-product. The metal product, being more dense than the electrolyte, remains at the bottom of the cell on the cathodic surface, where it builds in volume until it is removed from the cell, an operation that is performed periodically. Raw ore is introduced into the cell on a periodic cycle to maintain a particular concentration of reactants in the cell, and to maintain a consistent production rate of the product metal. The cell is operated in a continuous manner until corrosion or other similar destruction of the cell materials results in a loss of capability; a condition which occurs about every 5 years on average. During the operation of the cell, when carbon anodes are used and the byproduct oxidant is oxygen, oxidation and loss of the anodes mandates their replacement; an activity that occurs while the cell is in operation, and on a cycle of about two weeks.

In traditional Hall cells, the cell is maintained in a horizontal position, so that the metal product bath covers the entire surface of the cathode floor, and increases in volume equally throughout the volume of the cell. This ensures full use of the cell, as well as forced conduction from the cathodic metal surface to the current collector, despite the poor wetting between the metal of the cathode, and the carbon of the collector. These cells are generally electrically inefficient, as the thick metal pad surface is unpredictable in location due to magnetically induced convection currents. Because of this unpredictability, the anodes must be maintained at a safe distance from the metal pool to protect from electrical shorting. This distance is not optimum for the electrolytic reaction, and thus, electrical inefficiency results.

A preferred design for Hall cells utilizes what those skilled in the art term a "drained" cell configuration. In this type of cell, the entire cell, or cell floor, is angled at a slight degree to result in metal movement from the cathodic surface to some form of pool or well positioned somewhere in the cell. By draining the cathodic surface of the majority of the product metal, the unpredictability of the cathodic surface is eliminated, and the anodes can be positioned very close to this surface without concern of electrical shorting. A drained cell will typically exhibit a metal pad thickness of less than 2 inches, and more preferably below 1 inch. This configuration provides much greater electrical efficiency, resulting in 20% or greater savings in electrical energy. However, such a cell design can only be constructed from cathode materials that are wetted by aluminum, and thus, carbon by itself is not supportive of the application. Furthermore, the opportunity for interaction with the corrosive cryolite electrolyte is significantly increased in this design. Therefore, use of a wettable and corrosion resistant material, such as the subject materials and/or composites, is a key enabling technology in support of the drained cell improved design.

Use of any of these materials as electrodes in reduction cells may take various forms. It is conceivable that these materials could be formed into blocks and used as the exclusive material for a given electrode. These materials have been shown to be formable and sinterable into strong shapes using traditional ceramic forming processes, understood and practiced by those skilled in the art. For the best mechanical and corrosion resistant properties, it is preferred that the material or composite that comprises the electrodes would be processed in such a way as to provide and essentially dense material. For the purposes of this application, a dense material is one that is characterized by having no porosity that is open to the exterior surface of the material. In general, it is understood that such conditions occur when the measured density of the component is about 94% or greater compared to the theoretical density of the material from which it is constructed.

In practice, it is also possible that porous materials could be successfully used in electrode applications. Porous materials are generally easier to prepare, requiring less stringent processing condition compared to non-porous materials. In general, porous materials suitable for electrode applications may have total pore volumes of from about 6%, where open porosity is generally first exhibited, to about 50%. This is equivalent to a component density of about 94% to 50%, as compared to the theoretical density of the material of construction. The actual limitations of porosity will be determined by the strength, electrical conductivity and corrosion resistant properties of the specific compound. However, 50% dense specimens in general can be expected to provide suitable properties for electrode application, especially given the excellent corrosion performance of these materials.

Alternatively, it is possible that the materials of this disclosure might be applied to traditional or other suitable materials as a protective coating to provide the benefits of their improved performance. For instance, previous work in introducing $TiB_2$ and other materials into reduction cells has explored various methods of insertion. In many cases, the material is inserted as a surface layer, covering a more inexpensive but otherwise chemically vulnerable material. Often, the underlying material is carbon or graphite. The underlying material provides an inexpensive supportive materials, while the coating provides the corrosion resistant and physical properties required of the application.

The surface layer can be applied in a number of ways, most of which can be generalized as either tiled or coating layers. Tiled layers involve the application of previously prepared, rigid tiles of the material onto the underlying structure. Because of their nature, these tiles are typically segmented for simplification of handling, and are fastened onto the underlying material with some form of mechanical bond. Of particular advantage in this method is the ability to maximize the properties of the tile material by sintering, or other form of heat treating prior to the handling and fastening of the tiles. Tiling of the cathode surface in this general manner has been applied to the evaluation of $TiB_2$ materials for similar application.

Coatings are more along the line of a paint or similar material. These are often applied to the electrode structure during or after insertion into the cell, and are applied in any of a number of fluid coating methods including for instance, painting or troweling to cover the intended surface and impart the improved properties provided by the coating material. Paint-like coating might be applied either by a brush or roller, or alternately by spraying the paint onto the surface by use of gas pressure and atomization of the slurry in the manner of spray paint. A paste-like coating might be applied by troweling the material on to the surface much like a mortar, plaster or similar type of compound. The coatings are allowed to dry, and may be further rigidified by secondary chemical reactions or a heat treating operation that provides bonding. These coatings are typically continuous, and are not specifically mechanically bound to the underlying layer.

Alternately, it is possible to provide a coating of an intended material to an electrode surface by a thermal coating method such as chemical vapor or plasma or similar thermally enhanced method. Chemical vapor methods involve vaporization of reactant materials in such as way as to result in chemical combination and subsequent bonding in the vicinity of the intended surface. Plasma or thermally enhanced spraying most typically involves vaporization of powders of the intended product material, which are delivered at a high velocity and temperature against the intended surface, where they recrystallize and adhere to provide a coating. Both general methods are well represented in the technical literature. Various specific coating procedures, particularly those involving paints and pastes, have previously been evaluated in the application of $TiB_2$ and other materials, some of which represent current commercial methods.

The subject family of materials can be prepared in powder form, and thus can be prepared into tiles, or rather formed into slurries or pastes to use for continuous direct coatings. Therefore, the material can be applied to the cell application in any of the methods previously developed for other materials, such as TiB2.

EXAMPLES

1. $Ti_3SiC_2$ Powder was made by reacting stoichiometric amounts of titanium, silicon carbide and graphite powders. The powder was cold pressed and sintered to form dense parts. Analysis of the material via x-ray diffraction showed the resulting materials to be essentially pure $Ti_3SiC_2$. The billets were machined into bars for testing. Corrosion testing was performed by immersing portions of the bars into AlN crucibles containing synthetic cryolite and firing the samples at 1000° C. for 12 hours in air. Upon cooling, excess cryolite was easily scraped from the surface. The sample weight was evaluated before and after the corrosion test. Essentially no change in weight was observed during this test. Scanning electron micrography was performed of the surface and near-surface on a fracture surface to evaluate the remaining material. Primary $Ti_3SiC_2$ grains are still readily apparent on the surface and appear unchanged. This test confirms that the material is stable against cryolite salts at operational temperatures for aluminum smelting.

2. Dense samples were also prepared using the powder in Example 1 by hot pressing the powder in a graphite die to obtain dense billets. X-ray diffraction showed the resulting materials to be primarily $Ti_3SiC_2$ with residual levels of TiC at approximately 50% by volume. Scanning electron microscopy evaluation of the material showed both phases to be continuous throughout the microstructure. The corrosion of the samples was tested as in Example 1. As with the tests in Example 1 the corrosion on the samples was minimal. This test confirms stability against cryolite for composite samples of $Ti_3SiC_2$ and TiC.

3. A longer-term corrosion test of 100 hours was performed using the hot pressed samples of Example #2. The exposure temperature was 1000 C. for the first 50 hours and then 900 C. for the remaining time. Samples were removed from the furnace daily, stripped of excess cryolite, weighed, and returned to the furnace. Additional cryolite was added to the crucible as needed to maintain a constant depth. A portion of the test bar protruded from the cryolite at all times during the test and was exposed to the ambient air environment. Corrosion of these samples was minimal, though it varied somewhat between samples. Weight losses ranged from 0–20%. Differences in weight loss may be associated with the inaccuracy of the method of evaluating the samples, ie., sample damage could occur during cryolite removal. Corrosion was most pronounced at the cryolite/air interface, but was not excessive. Evaluation of the microstructure of corroded samples shows the formation of a thin reaction production layer which adheres to the sample coupons, and appears to be protective. Reaction layer thickness was on the order of tens of microns. This test confirmed cryolite stability for longer periods of time. It also examined the corrosion of the material in intimate contact with air, confirming that material operation in an anode configuration (where oxygen is readily present) is possible.

4. A sample of $Ti_3SiC_2$ was also run in the conditions of Example #3 but with the addition of aluminum metal and aluminum oxide to the cryolite. There was no apparent difference in corrosion performance of this sample. The aluminum metal wetted the $Ti_3SiC_2$ material as determined by the angle of the interface between the material and residual aluminum. This test confirms that the addition of all primary species in an aluminum smelting operation does not have adverse effect on the corrosion resistance of the material.

5. Pellet samples of $Ti_3SiC_2$ were prepared using a process similar to that in Example 2. Compositions ranged from 5–50% by volume TiC, and sample densities were generally greater than 90% of the theoretical value. Scanning electron microscopy confirmed that the $Ti_3SiC_2$ phase was continuous in all samples. Samples were placed in a graphite holder and inserted into a test cell for corrosion testing. The cell was configured such that the samples and graphite holder were covered with aluminum, aluminum oxide and cryolite with the entire cell heated to about 950° C. using external heating elements. A graphite plate was inserted into the top of the cell, and this plate and the sample holder plate were connected to an electrical source to provide a low level of current at approximately 1.5 volts through the test cell. In this configuration, the graphite plate holding the test specimens was arranged to act as the cathode. Samples were exposed to these conditions for 5 days continuously. Following this exposure test, samples were removed from the graphite holder and characterized. All samples showed little or no visible change in diameter or height, and corners were not substantially rounded by corrosion. Upon examination of the interfacial surface by scanning electron microscopy, a very thin adherent reaction layer on the order of tens of microns was observed. Additionally, residual aluminum was found to wet all of the sample surfaces, even penetrating into open surface porosity. This test confirmed the stability of the primary material, as well as composites with TiC, in the composition of an aluminum smelting cell while also exposed to electrical current (ie., no electrochemical etching/corrosion).

6. Pellets similar to those described in example 5 were prepared, however the process employed involved dry pressing of powders followed by sintering. The nominal density of the samples were approximately 70%, and the samples exhibited open porosity. Compositions ranged from 5%–25% TiC. These samples were exposed to the testing procedures described in example 5. Upon completion, the samples were found to exhibit little sign of corrosion, and were essentially the same quality as the dense samples described in example 5. This test confirmed the stability of the material in a porous form, where a significant portion of the internal structure of the material is exposed to the corrosive materials.

7. Comparative example 1: Corrosion testing as described in example 3 was also performed using test bars of $TiB_2$ (hot pressed with 2% Ni, 99% density) were tested under identical corrosion conditions as a comparison. The $TiB_2$ samples showed much more significant weight loss. After 50 hours exposure, weight loss ranged from 30–40%. Testing of these samples was interrupted at this point to save some material for evaluation. This test shows that the conditions evaluated in early evaluation were significantly corrosive to be readily observable well within the exposure time of the test. Poor performance of $TiB_2$, which has previously been suggested as a suitable material for aluminum smelting equipment, provides comparative evidence of the superior stability of $Ti_3SiC_2$ and $Ti_3SiC_2$ composites with TiC in this corrosive system.

8. Comparative example 2: Corrosion testing as described in example 5 and 6 was performed on various samples of $TiB_2$. Samples included hot pressed components at high density (>95% dense) as well as porous samples (~70% dense) prepared by pressing and sintering. Under the test conditions of example 5, all $TiB_2$ samples were wetted by aluminum, which provided some protection of the material from the cryolite salt. Despite this protection, the best samples (in all cases, dense specimens) showed no better than equivalent results compared to the samples of example 5, as evaluated by examination of the samples visually and by scanning electron microscopy. Porous samples generally fared worse than dense samples, demonstrating that in materials that exhibit some level of corrosive attack, exposure of more material via pores increases the reaction rate of the material. This test confirms that $Ti_3SiC_2$ and $Ti_3SiC_2$ composites with TiC are superior to $TiB_2$ in simulated reduction cell conditions.

While my invention has been described in terms of a specific embodiment, it will be appreciated that other embodiments could readily be adapted by one skilled in the art. Therefore, the invention should not be limited to the embodiments so disclosed but should be deemed to encompass additional embodiments considered obvious to one skilled in the art.

I claim:

1. An electrode comprising at least one compound having the chemical formula $M_3NX_2$ or $M_2NX$, where M is a transition metal, N is a group 3a, 4a or 5a element, and X is carbon or nitrogen.

2. The electrode of claim 1, wherein M is selected from the group consisting of titanium, zirconium, hafnium, vanadium, niobium, tantalum, chromium and molybdenum and wherein N is selected from the group consisting of aluminum, silicon, gallium and germanium.

3. The electrode of claim 1, wherein the compound is selected from the group consisting of $Ti_3SiC_2$, $Ti_3GeC_2$, $Ti_2AlC$, $Ti_2GeC$, and $Ti_2AlN$.

4. The electrode of claim 1, wherein the electrode comprises essentially $Ti_3SiC_2$.

5. The electrode of claim 1, wherein the electrode consists essentially of the compound.

6. The electrode of claim 1, wherein the electrode in an anode.

7. The electrode of claim 1, wherein the electrode is a cathode.

8. The electrode of claim 1, wherein the electrode comprises a plurality of compounds having the chemical formula $M_3NX_2$ or $M_2NX$, where M is a transition metal, N is a group 3a, 4a or 5a element, and X is carbon or nitrogen.

9. The electrode of claim 1, having a surface layer and an underlayer, wherein the surface layer comprises the compound.

10. The electrode of claim 9, wherein the underlayer comprises an electrically conductive material which is different than the compound.

11. The electrode of claim 10, wherein the underlayer comprises carbon.

12. The electrode of claim 10, wherein the underlayer comprises a metal, a metal alloy, or a mixture thereof.

13. The electrode of claim 9, wherein the compound is sufficiently dense so as to exhibit essentially no open porosity.

14. The electrode of claim 13, wherein the compound exhibits no more than 6 percent by volume porosity and essentially none of the porosity is connected with the surface layer.

15. The electrode of claim 9, wherein the compound is porous.

16. The electrode of claim 15, wherein the compound exhibits a porosity level from about 50 percent to 94 percent by volume.

17. The electrode of claim 9, wherein the surface layer is tiled.

18. The electrode of claim 17, wherein the surface layer has a thickness of less than 2 inches.

19. The electrode of claim 17, wherein the surface layer has a thickness of less than 1 inch.

20. The electrode of claim 17, wherein the surface layer is produced by a process that includes heat treating tiles.

21. The electrode of claim 17, wherein the surface layer exhibits open porosity.

22. The electrode of claim 17, wherein the surface layer is supported by solid forms of carbon, graphite or a mixture thereof.

23. The electrode of claim 9, wherein the surface layer is a continuous coating.

24. The electrode of claim 1, wherein the compound is present in a quantity of between 30 to 99 percent by volume.

25. The electrode of claim 24, wherein the electrode contains the compound and TiC.

26. The electrode of claim 24, where the electrode contains the compound and carbon.

27. The electrode of claim 24, wherein the electrode contains the compound and at least one material which exhibits electrical conductivity and chemical stability against cryolite and aluminum at least as well as carbon.

28. A metal reduction cell comprising the electrode of claim 1.

29. The metal reduction cell of claim 28, wherein the metal reduction cell is a Hall-Heroult cell.

30. The metal reduction cell of claim 29, wherein the cell comprises and an anode and a cathode which are located at a distance apart of 2 inches or less.

31. The metal reduction cell of claim 30, wherein the cell comprises and an anode and a cathode which are located at a distance apart of 1 inch or less.

* * * * *

UNITED STATES PATENT AND TRADEMARK OFFICE

CERTIFICATE OF CORRECTION

PATENT NO. : 6,312,570 B1
DATED : November 6, 2001
INVENTOR(S) : Thomas J. Mroz, Jr.

It is certified that error appears in the above-identified patent and that said Letters Patent is hereby corrected as shown below:

Column 1,
Line 10, insert the following as the second paragraph:

-- This invention was made with Government support under Contract No. 316704-A-A5 awarded by Battelle Memorial Institute, Pacific Northwest Division, for the Department of Energy. The Government has certain rights in the invention. --

Claim 6,
Line 1, replace "in" with -- is --.

Claim 30,
Line 2, delete "and" after "comprises".

Claim 31,
Line 2, delete "and" after "comprises".

Signed and Sealed this

Ninth Day of April, 2002

*Attest:*

*Attesting Officer*

JAMES E. ROGAN
*Director of the United States Patent and Trademark Office*